US011364529B2

(12) United States Patent
Zhang et al.

(10) Patent No.: US 11,364,529 B2
(45) Date of Patent: Jun. 21, 2022

(54) VARIABLE-DIAMETER FULL-SUPPORT MANDREL STRUCTURE WITH SLIDER-TYPE CROSS SECTION FOR PREVENTING REVERSE ROTATION OF RATCHET WHEEL

(71) Applicant: ZHEJIANG UNIVERSITY, Hangzhou (CN)

(72) Inventors: Shuyou Zhang, Hangzhou (CN); Zili Wang, Hangzhou (CN); Guodong Yi, Hangzhou (CN); Mengyu Fu, Hangzhou (CN)

(73) Assignee: ZHEJIANG UNIVERSITY, Hangzhou (CN)

( * ) Notice: Subject to any disclaimer, the term of this patent is extended or adjusted under 35 U.S.C. 154(b) by 0 days.

(21) Appl. No.: 17/442,626

(22) PCT Filed: Jun. 9, 2020

(86) PCT No.: PCT/CN2020/095156

§ 371 (c)(1),
(2) Date: Sep. 24, 2021

(87) PCT Pub. No.: WO2020/211883

PCT Pub. Date: Oct. 22, 2020

(65) Prior Publication Data

US 2022/0143668 A1 May 12, 2022

(30) Foreign Application Priority Data

Apr. 19, 2019 (CN) ..... 201910316591.6

(51) Int. Cl.
*B21D 9/00* (2006.01)
*B21D 9/03* (2006.01)

(52) U.S. Cl.
CPC ..... *B21D 9/03* (2013.01)

(58) Field of Classification Search
CPC . B21D 9/01; B21D 9/03; B21D 39/08; B21D 39/20; B21C 25/04; B21C 3/16
See application file for complete search history.

(56) References Cited

U.S. PATENT DOCUMENTS 3,109,477 A * 11/1963 Avera ..... B21D 9/01 72/481.2
4,007,622 A 2/1977 Galperin et al.
4,164,135 A * 8/1979 Clavin ..... B21D 9/03 269/48.1

FOREIGN PATENT DOCUMENTS

CN 102513422 A 6/2012
CN 107138569 A 9/2017
(Continued)

*Primary Examiner* — Debra M Sullivan
(74) *Attorney, Agent, or Firm* — Bayramoglu Law Offices LLC

(57) ABSTRACT

A variable-diameter full-support mandrel structure with a slider-type cross section for preventing a reverse rotation of a ratchet wheel includes a movable mandrel segment and a straight shank, and the movable mandrel segment and the straight shank are connected through a quick-disconnect universal joint. A rotating shaft of the movable mandrel segment is provided with a connecting rod mounting flange, a ratchet wheel, a reverse ratchet wheel, a bearing, and a limit clamp ring in sequence. An outer ring of the bearing is provided with a pawl mounting frame. The connecting rod mounting flange and the pawl mounting frame are respectively hinged to a long connecting rod and a short connecting rod, and the long connecting rod and the short connecting rod are hinged to slider components in an outer ring. The slider component has a Z-shaped structure composed of two layers of arc blocks.

7 Claims, 4 Drawing Sheets

(56) References Cited

FOREIGN PATENT DOCUMENTS

| | | | |
|---|---|---|---|
| CN | 108097762 | A | 6/2018 |
| CN | 108296330 | A | 7/2018 |
| CN | 108435852 | A | 8/2018 |
| CN | 110216178 | A | 9/2019 |
| JP | H07116740 | A | 5/1995 |

* cited by examiner

VARIABLE-DIAMETER FULL-SUPPORT MANDREL STRUCTURE WITH SLIDER-TYPE CROSS SECTION FOR PREVENTING REVERSE ROTATION OF RATCHET WHEEL

CROSS REFERENCE TO THE RELATED APPLICATIONS

This application is the national phase entry of International Application No. PCT/CN2020/095156, filed on Jun. 9, 2020, which is based upon and claims priority to Chinese Patent Application No. 201910316591.6, filed on Apr. 19, 2019, the entire contents of which are incorporated herein by reference.

TECHNICAL FIELD

The present disclosure belongs to the technical field of prevention of defects such as wrinkling and cross-section flattening and distortion in the bending of circular pipes, and particularly relates to a variable-diameter full-support mandrel structure with a slider-type cross section for preventing a reverse rotation of a ratchet wheel.

BACKGROUND

Possessing the characteristics such as hollow cross-section, light weight, low consumption, and high efficiency, circular bends have been widely used in aerospace, ships, automobiles, and other industries. The forming process of a complex bend (such as thin wall, large diameter, and large bending angle) is generally accompanied with defects such as wrinkling, and cross-section flattening and distortion. Inserting a mandrel into the pipe blank to be bent can effectively reduce the wrinkling and the cross-section flattening and distortion in the forming process of a bend. Therefore, the study on the structure and performance of mandrels has great significance for improving the quality and efficiency of pipe bending.

Mature mandrels currently used in production include rigid mandrels and flexible mandrels. The overall structure of a rigid mandrel is nearly rigid and has no kinematic pairs. A rigid mandrel is generally composed of a straight shank part and an arc-shaped end that contacts a bending part, and the length of the arc-shaped end extending into the bending part should not be too large due to structural limitations, resulting in limited support provided. A flexible mandrel has a flexible bending support part and is generally composed of a straight shank and one or more movable mandrel segments, and the movable mandrel segments can be bent together with a pipe and then taken out to provide better interior support for bending parts that are prone to defects.

The existing mandrels mainly have the following shortcomings: (1) Since the radial size of a mandrel used in practical production is fixed, the forming of pipe fittings of different diameters requires mandrels of the corresponding sizes, resulting in increased production costs of bends and increased storage costs of mandrels. (2) In view of the problems mentioned in (1), in the prior art there have been many solutions to change the diameter of the mandrel. These solutions generally have two problems: a) after the diameter is changed (especially after the diameter is increased), the outer contour of the circular cross-section of the mandrel is no longer a complete circle, but has a gap, which weakens the supporting effect of the mandrel; and b) the adjustment and fixing for the diameter involves a complicated process, where the movable mandrel segments need to be removed one by one for adjustment, and limiting locking nuts, clamp rings, and other parts need to be disassembled and assembled for each movable mandrel segment, which reduces the use efficiency of the mandrel. (3) The movable mandrel segments in a multi-segment flexible mandrel are typically connected by hinges or spherical hinges. A hinge with only one degree of freedom (DOF) will limit the direction of the mandrel during use, which results in uneven wear of the mandrel and consequently shortens its lifespan. These difficulties in the assembly and disassembly of spherical hinges cause considerable inconvenience in the case where the number of movable mandrel segments need to be increased or decreased according to varying bending parameters.

SUMMARY

In order to solve the problems in the background art, the present disclosure discloses a variable-diameter full-support mandrel structure with a slider-type cross section for preventing a reverse rotation of a ratchet wheel, which realizes the rapid adjustment of a diameter of a multi-segment flexible mandrel and helps to reduce the processing cost and the processing efficiency of bends (circular pipes using mandrels).

The present disclosure adopts the following technical solutions:

The mandrel structure of the present disclosure includes a straight shank and one or more movable mandrel segments. The straight shank and a movable mandrel segment are connected through a quick-disconnect universal joint, and two adjacent movable mandrel segments are connected through the quick-disconnect universal joint; the inside of the movable mandrel segment has a shafting structure, which includes a rotating shaft, a bearing, a ratchet mechanism, a connecting rod mounting flange, and slider components; the ratchet mechanism is mainly composed of a pawl mounting frame, a pawl sliding shaft, a ratchet wheel, a reverse ratchet wheel, a pawl, and a reverse pawl; the rotating shaft is mainly composed of a front shaft segment, a middle shaft segment, and a rear shaft segment that are connected in sequence; the middle shaft segment has a regular hexagonal cross section, and the front shaft segment and the rear shaft segment both have a circular cross section; a shaft shoulder is provided at a transition between the front shaft segment and the middle shaft segment, and the shaft shoulder serves as one end of the rotating shaft for axial location; the connecting rod mounting flange, the ratchet wheel, and the reverse ratchet wheel each with a regular hexagonal central hole are fitted with and sequentially sleeved on the middle shaft segment; an outer diameter of the rear shaft segment is smaller than an outer diameter of the middle shaft segment, the bearing and a limit clamp ring are sequentially sleeved on the rear shaft segment, and the limit clamp ring serves as the other end of the rotating shaft for axial location; the bearing is located between the reverse ratchet wheel and the limit clamp ring, the bearing is in tight contact with an end face of the reverse ratchet wheel away from the connecting rod mounting flange, and the pawl mounting frame is mounted on an outer ring of the bearing; a plurality of protrusions are evenly arranged on an outer side face of the pawl mounting frame in a circumferential direction, a mounting hole is formed at a position of each protrusion adjacent to an outer end, and a quadrilateral hole is formed at a position of one of the protrusions adjacent to an end of the rotating shaft; a plurality of through holes are evenly arranged along an outer edge of the connecting rod mounting flange in a circumferential direction; and an arc sliding groove that is arranged coaxially with the outer edge of the connecting rod mounting flange is formed on the connecting rod mounting flange, and the arc sliding groove is located between the through holes and the ratchet wheel.

One end of the pawl sliding shaft passes through the arc sliding groove, and the other end of the pawl sliding shaft passes through the quadrilateral hole of the protrusion of the pawl mounting frame; the pawl sliding shaft can move back and forth along a central axis of the quadrilateral hole, and both ends of the pawl sliding shaft are provided with flanges to prevent the pawl sliding shaft from disengaging from the arc sliding groove or the quadrilateral hole during a sliding process; and a pawl assembly is fixedly sleeved on the pawl sliding shaft located between the connecting rod mounting flange and the pawl mounting frame, and the pawl assembly is formed by connecting the pawl and the reverse pawl.

Each protrusion on the pawl mounting frame and a through hole in the connecting rod mounting flange corresponding to the protrusion are connected to an identical slider component through a short connecting rod and a long connecting rod, respectively; the slider component has a Z-shaped structure composed of two layers of arc blocks; one end of the short connecting rod and one end of the long connecting rod are respectively hinged to inner walls of the arc blocks to form coaxial revolute pairs, and the other end of the short connecting rod and the other end of the long connecting rod are respectively hinged to the mounting hole of the protrusion on the pawl mounting frame and the through hole of the connecting rod mounting flange; a positioning pin hole is formed on one layer of the two layers of arc blocks along a central axis of the rotating shaft, and a slider positioning pin is mounted inside the positioning pin hole through interference fit; the other layer of the two layers of arc blocks is provided with a slider positioning pin sliding groove fitted with the slider positioning pin in an adjacent slider component; a positioning pin on one layer of the slider component is inserted into the slider positioning pin sliding groove on a different layer of an adjacent slider component; and all the slider components are connected in a circumferential direction to form a complete circular ring.

The quick-disconnect universal joint is mainly composed of a fixed joint and a quick-disconnect joint that are hinged through a universal joint; a central blind hole for mounting the rotating shaft of the movable mandrel segment or a connecting shaft of the straight shank is formed on each of the fixed joint and the quick-disconnect joint at both ends of the quick-disconnect universal joint; the quick-disconnect joint is connected to a central hole of the universal joint through a quick-disconnect shaft; one end of the quick-disconnect shaft is in an interference fit with the quick-disconnect joint, and the other end of the quick-disconnect shaft is hinged to a limit shaft; and when the limit shaft is adjusted to be not coaxial with the quick-disconnect shaft, the quick-disconnect joint is limited and will not disengage.

When the rotating shaft is relatively fixed, the connecting rod mounting flange, the ratchet wheel, and the reverse ratchet wheel are fixed accordingly, and the pawl mounting frame arranged in the outer ring of the bearing can rotate relative to the rotating shaft. When the rotating shaft is fixed and the pawl sliding shaft slides along a central arc of the arc sliding groove, the pawl mounting frame can be driven to rotate relative to the rotating shaft, so as to drive the slider components to move in a radial direction under the guidance of a mechanism movement of the short and long connecting rods, thereby changing a diameter of the movable mandrel segment. When the pawl sliding shaft slides from one end of the arc sliding groove to the other end, a diameter of an outer ring of the movable mandrel segment first increases to a limit value and then decreases. After the diameter of the movable mandrel segment increases, gaps between the two layers of arc blocks in the slider components on the entire circumference will be filled. As a preferred solution, a scale can be engraved on the arc sliding groove on a side of the connecting rod mounting flange adjacent to the shaft shoulder, and a scale can be read through a position of the pawl sliding shaft to accurately reflect a diameter of the movable mandrel segment, which is convenient for use.

Ratchet teeth of the ratchet wheel and ratchet teeth of the reverse ratchet wheel are arranged in opposite directions. When the pawl assembly of the pawl sliding shaft is pushed to be in contact with the pawl mounting frame, the reverse pawl cooperates with the reverse ratchet wheel to prevent a reverse rotation, and the pawl and the ratchet wheel are in a disengaged state; and when the pawl sliding shaft is pushed to be in contact with the pawl assembly and the connecting rod mounting flange, the pawl cooperates with the ratchet wheel, and the reverse pawl and the reverse ratchet wheel are in a disengaged state.

A shaft segment of the pawl sliding shaft that is slidably connected to the protrusion on the pawl mounting frame has a quadrilateral cross section matched with the quadrilateral hole of the protrusion to limit a rotation of the pawl sliding shaft relative to the pawl mounting frame; and a shaft segment of the middle shaft segment that has a regular hexagonal cross section is configured to limit a rotation of the connecting rod mounting flange, the ratchet wheel, and the reverse ratchet wheel relative to the rotating shaft.

The outer ring of the movable mandrel segment may be composed of an odd number of slider components.

The limit shaft of the quick-disconnect universal joint can be adjusted to be coaxial with the quick-disconnect shaft for quick disassembly and assembly, and when in use, the limit shaft is adjusted to be not coaxial with the quick-disconnect shaft for assembly and limiting.

An outer ring of the movable mandrel segment is limited through linkage among the odd number of sliders, which leads to a simple structure, a specified movement, and an expanded diameter change range. When a diameter of the movable mandrel segment increases, the upper and lower layers of adjacent slider components will compensate each other for gaps in a complete circle to ensure a prominent supporting effect.

When the present disclosure is used, it is only necessary to make the pawl mounting frame fixed relatively and the straight shank of the mandrel rotate or make the straight shank relatively fixed and the pawl mounting frame rotate to realize the change of a diameter of a movable mandrel segment. Since the universal joint can transmit a torque, each movable mandrel segment does not need to be disassembled and adjusted separately. Since the ratchet wheel can only rotate in one direction relative to the pawl, a diameter of the mandrel will not be reduced when the mandrel is working, and thus there is no need to manually fix a radial size of the mandrel.

Beneficial effects of the present disclosure:

(1) The present disclosure realizes a diameter change of a bend mandrel, such that an identical mandrel can be used for the bending processing of circular pipe fittings with different diameters, which can reduce a production cost of bends.

(2) A diameter change adjustment process of the present disclosure is quick and convenient, and the ratchet mechanism can effectively ensure the limit after a diameter change, which improves the efficiency and reliability of bending processing.

(3) Through sliders with a double-layer structure, the present disclosure realizes a diameter change and provides support for a pipe blank to be bent. After a diameter increases, the sliders with a double-layer structure can compensate for gaps in a circumference of a cross section, thereby fully ensuring a support effect.

(4) The present disclosure uses a quick-disconnect universal joint to connect the movable mandrel segments, which helps to increase or reduce the number of movable mandrel segments according to bending parameters and enhances the adaptability to actual production conditions.

In the figures: 1: straight shank; 2: straight shank positioning pin hole; 3: quick-disconnect universal joint; 4: movable mandrel segment; 5: rotating shaft; 6: limit clamp ring; 7: bearing; 8: pawl mounting frame; 9: short connecting rod; 10: slider component; 11: long connecting rod; 12: connecting rod mounting flange; 13: pawl sliding shaft; 14: ratchet wheel; 15: reverse ratchet wheel; 16: shaft shoulder; 17: middle shaft segment; 18: pawl; 19: reverse pawl; 20: arc sliding groove; 21: slider positioning pin sliding groove; 22: slider positioning pin; 23: fixed joint; 24: central blind hole; 25: threaded hole; 26: universal joint; 27: quick-disconnect joint; and 28: quick-disconnect shaft.

DETAILED DESCRIPTION OF THE EMBODIMENTS

The present disclosure is described in detail below with reference to the accompanying drawings and examples.

Figure 1:
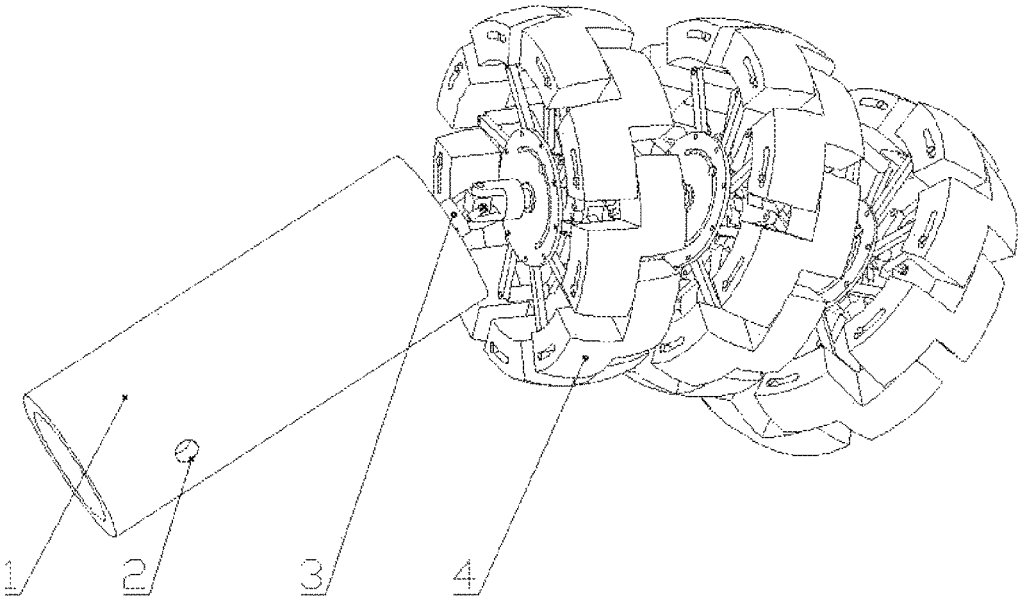
FIG. 1 is a schematic diagram illustrating the structure of the present disclosure.

As shown in FIG. 1, the present disclosure includes a straight shank 1 and one or more movable mandrel segments 4; the straight shank 1 and the movable mandrel segment 4 are connected through a quick-disconnect universal joint 3, and two adjacent movable mandrel segments 4 are connected through the quick-disconnect universal joint 3; and the straight shank 1 is provided with a straight shank positioning pin hole 2. When the present disclosure is used in a numerical-controlled pipe bending machine, the straight shank positioning pin hole 2 can cooperate with another positioning pin shaft to limit the possible axial rotation of the straight shank 1 during a bending process.

Figure 2:
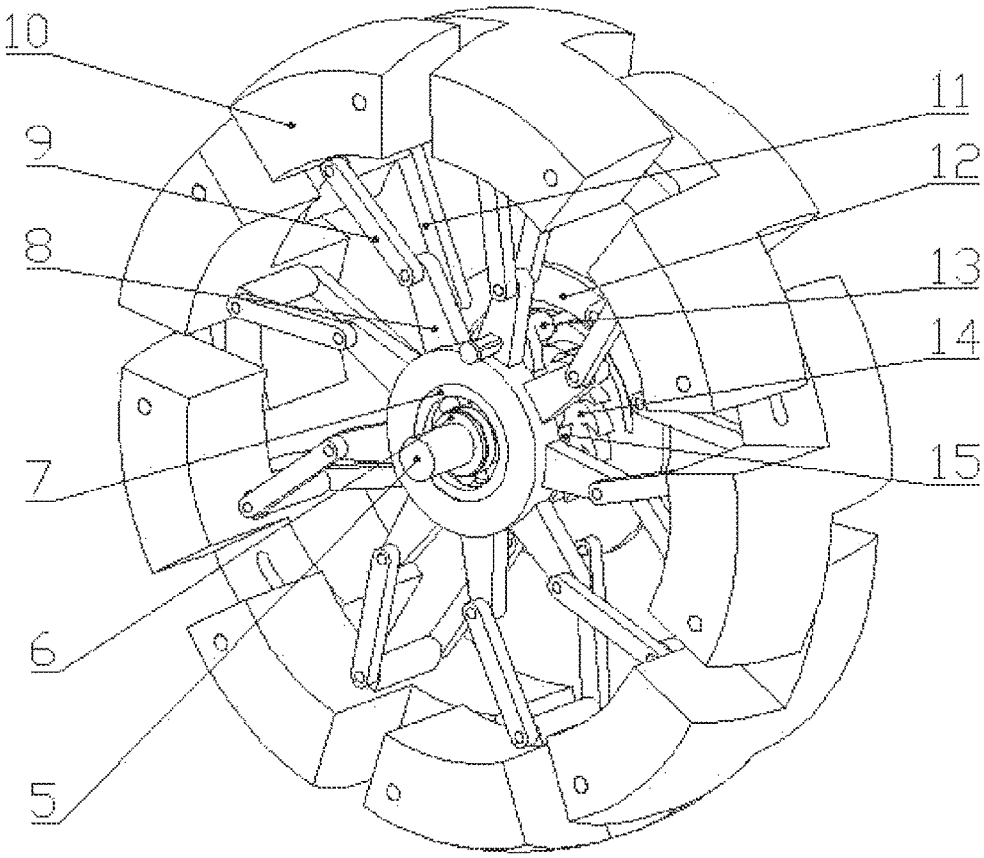
FIG. 2 is a schematic diagram illustrating the three-dimensional (3D) structure of a slider-type variable-diameter mandrel segment of the present disclosure.
Figure 3:
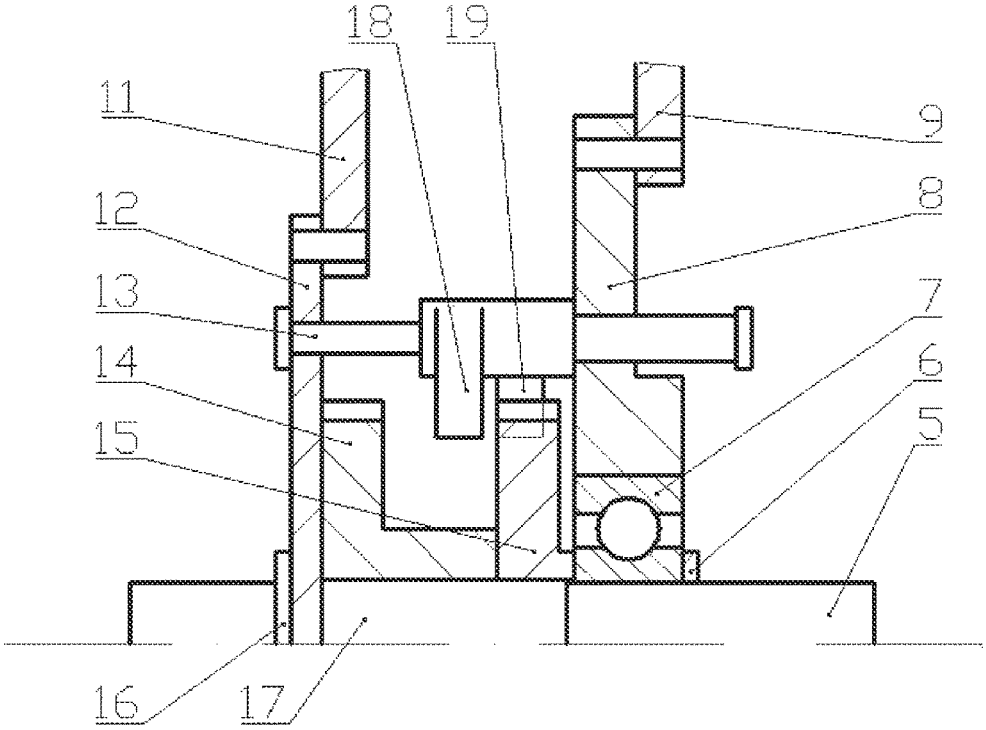
FIG. 3 is a cross-sectional view illustrating a shafting structure of a slider-type variable-diameter mandrel segment of the present disclosure.

As shown in FIG. 2 and FIG. 3, the inside of the movable mandrel segment 4 has a shafting structure, which includes a rotating shaft 5, a bearing 7, a ratchet mechanism, a connecting rod mounting flange 12, and slider components 10; the ratchet mechanism is mainly composed of a pawl mounting frame 8, a pawl sliding shaft 13, a ratchet wheel 14, a reverse ratchet wheel 15, a pawl 18, and a reverse pawl 19; the rotating shaft 5 is mainly composed of a front shaft segment, a middle shaft segment 17, and a rear shaft segment that are connected in sequence; the middle shaft segment 17 has a regular hexagonal cross section, and the front shaft segment and the rear shaft segment both have a circular cross section; a shaft shoulder 16 is provided at a connection between the front shaft segment and the middle shaft segment, and the shaft shoulder 16 serves as one end of the rotating shaft 5 for axial location; the connecting rod mounting flange 12, the ratchet wheel 14, and the reverse ratchet wheel 15 each with a regular hexagonal central hole are fitted with and sequentially sleeved on the middle shaft segment 17: an outer diameter of the rear shaft segment is smaller than an outer diameter of the middle shaft segment 17, the bearing 7 (a deep groove ball bearing is preferred here) and a limit clamp ring 6 are sequentially sleeved on the rear shaft segment, and the limit clamp ring 6 serves as the other end of the rotating shaft 5 for axial location; the bearing 7 is located between the reverse ratchet wheel 15 and the limit clamp ring 6, the bearing 7 is in tight contact with an end face of the reverse ratchet wheel 15 away from the connecting rod mounting flange 12, and the pawl mounting frame 8 is mounted on an outer ring of the bearing 7; a plurality of protrusions are evenly arranged on an outer side face of the pawl mounting frame 8 in a circumferential direction, a mounting hole is formed at a position of each protrusion adjacent to an outer end, and a quadrilateral hole is formed at a position of one of the protrusions adjacent to an end of the rotating shaft; a plurality of through holes are evenly arranged along an outer edge of the connecting rod mounting flange 12 in a circumferential direction; and an arc sliding groove 20 that is arranged coaxially with the outer edge of the connecting rod mounting flange 12 is formed on the connecting rod mounting flange 12, and the arc sliding groove 20 is located between the through holes and the ratchet wheel 14.

Figure 4:
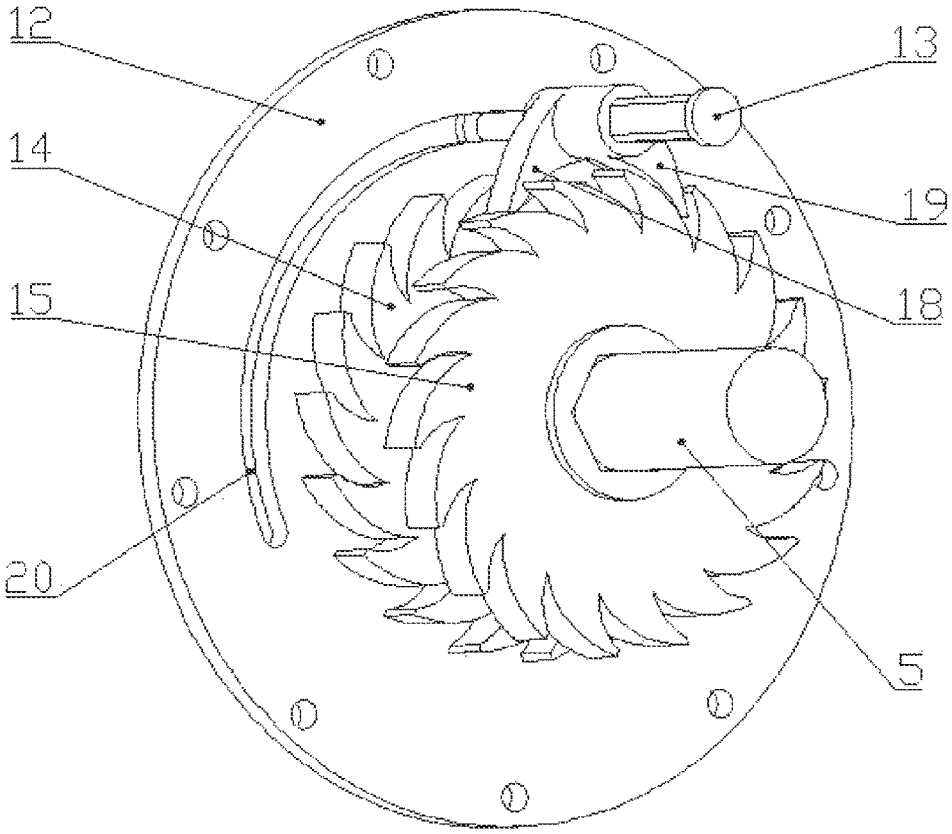
FIG. 4 is a schematic diagram of the ratchet mechanism in the shafting structure of the mandrel of the present disclosure.

As shown in FIG. 4, one end of the pawl sliding shaft 13 passes through the arc sliding groove 20, and the other end of the pawl sliding shaft passes through the quadrilateral hole of the protrusion of the pawl mounting frame 8; the pawl sliding shaft 13 can move back and forth along a central axis of the mounting hole, and both ends of the pawl sliding shaft 13 are provided with flanges to prevent the pawl sliding shaft 13 from disengaging from the arc sliding groove 20 or the quadrilateral hole during a sliding process; a pawl assembly is fixedly sleeved on the pawl sliding shaft 13 located between the connecting rod mounting flange 12 and the pawl mounting frame 8, and the pawl assembly is formed by connecting the pawl 18 and the reverse pawl 19; and each protrusion on the pawl mounting frame 8 and a through hole in the connecting rod mounting flange 12 corresponding to the protrusion are connected to an identical slider component 10 through a short connecting rod 9 and a long connecting rod 11, respectively.

Figure 5:
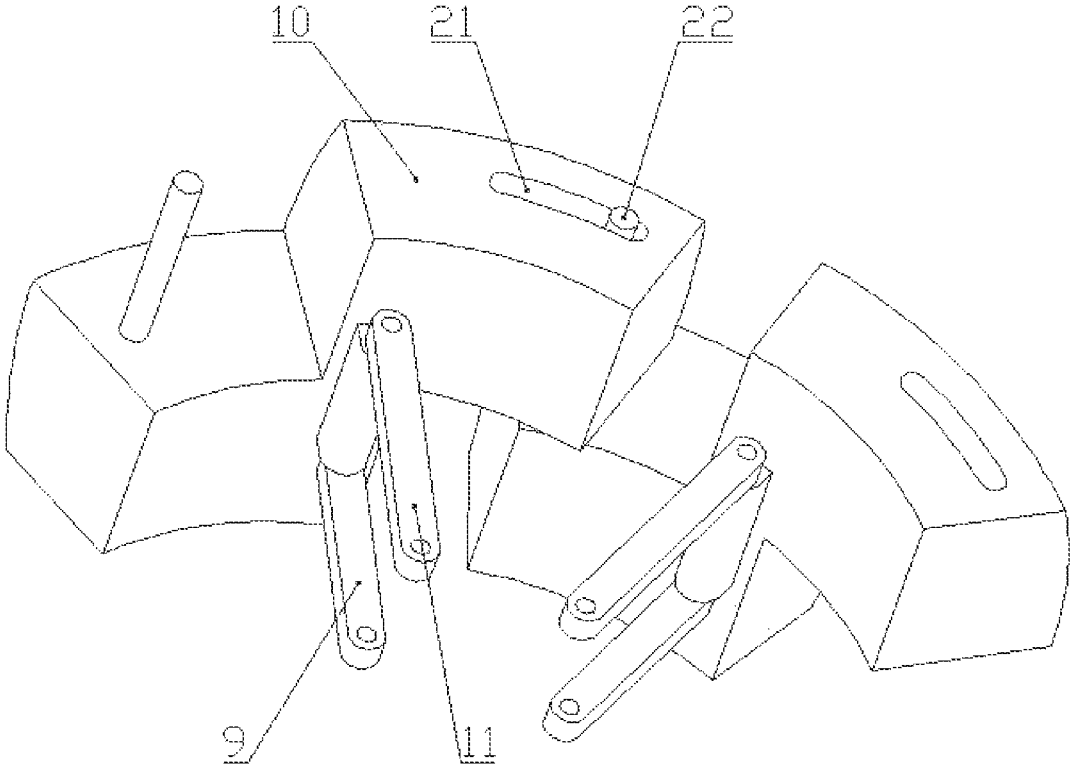
FIG. 5 is a schematic diagram illustrating the interconnection of sliders in a mandrel segment of the present disclosure.

As shown in FIG. 5, the slider component 10 has a Z-shaped structure composed of two layers of arc blocks, one end of the short connecting rod 9 and one end of the long connecting rod 11 are respectively hinged to inner walls of the arc blocks to form coaxial revolute pairs, and the other end of the short connecting rod 9 and the other end of the long connecting rod 11 are respectively hinged to the mounting hole of the protrusion on the pawl mounting frame 8 and the through hole of the connecting rod mounting flange 12; a positioning pin hole is formed on one layer of the two layers of arc blocks along a central axis of the rotating shaft 5, and a slider positioning pin 22 is mounted inside the positioning pin hole through interference fit; the other layer of the two layers of arc blocks is provided with a slider positioning pin sliding groove 21 fitted with the slider positioning pin 22 in an adjacent slider component 10; a positioning pin on one layer of the slider component 10 is inserted into the slider positioning pin sliding groove 21 on a different layer of an adjacent slider component 10; and all the slider components 10 are connected in a circumferential direction to form a complete circular ring.

Figure 8:
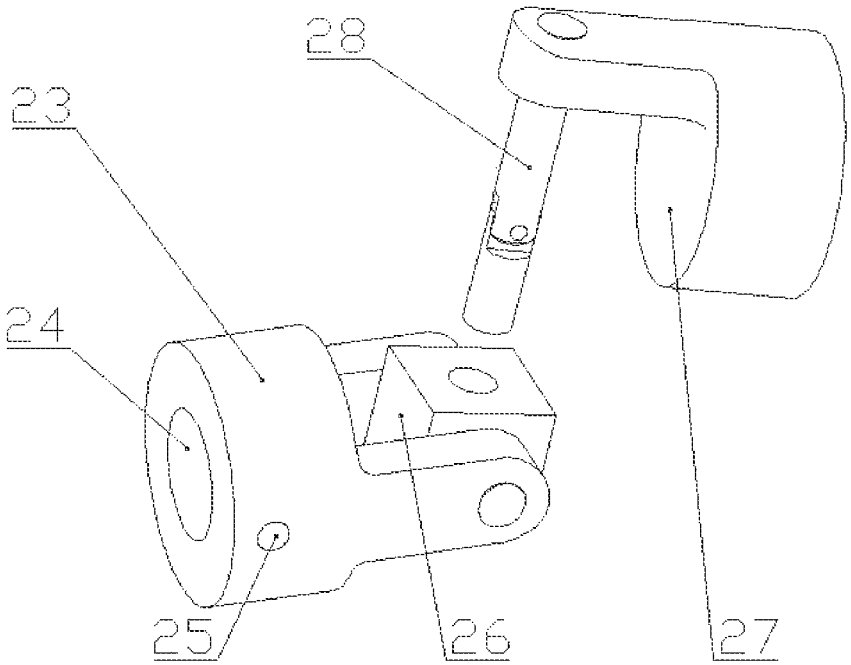
FIG. 8 is a schematic diagram illustrating a structure of the quick-disconnect universal joint connecting the mandrel segments of the present disclosure.

As shown in FIG. 8, the quick-disconnect universal joint 3 is mainly composed of a fixed joint 23 and a quick-disconnect joint 27 that are hinged through a universal joint 26; a central blind hole 24 for mounting the rotating shaft 5 of the movable mandrel segment 4 or a connecting shaft of the straight shank 1 is formed on each of the fixed joint 23 and the quick-disconnect joint 27 at both ends of the quick-disconnect universal joint 3, and the connecting shaft is fixed by a threaded hole 25: the quick-disconnect joint 27 is connected to a central hole of the universal joint 26 through a quick-disconnect shaft 28; and one end of the quick-disconnect shaft 28 is in an interference fit with the quick-disconnect joint 27, and the other end of the quick-disconnect shaft 28 is hinged to a limit shaft. When it is necessary to assemble with or disassemble from the fixed joint 23, the quick-disconnect shaft 28 is adjusted to be coaxial with the limit shaft and thus can be quickly inserted into or removed from the central hole of the universal joint 26. When the movable mandrel segments 4 are connected and need to be used, the quick-disconnect shaft and the limit shaft are adjusted to be not coaxial for limiting, thereby ensuring that the movable mandrel segment 4 does not disengage in operation and can well transmit a torque.

As shown in FIG. 2, after a diameter of the movable mandrel segment 4 increases, gaps occurring in the two full circles formed by the two layers of arc blocks in the slider components 10 will be filled, resulting in a prominent supporting effect. Through the linkage of an odd number of sliders, the entire circumference can provide a circle-like supporting effect. 9 slider components 10 are preferred here, and there are 9 long connecting rods and 9 short connecting rods correspondingly. The more the sliders, the more similar the supporting effect provided by the mandrel to a complete and regular circular cross section.

Figure 6:
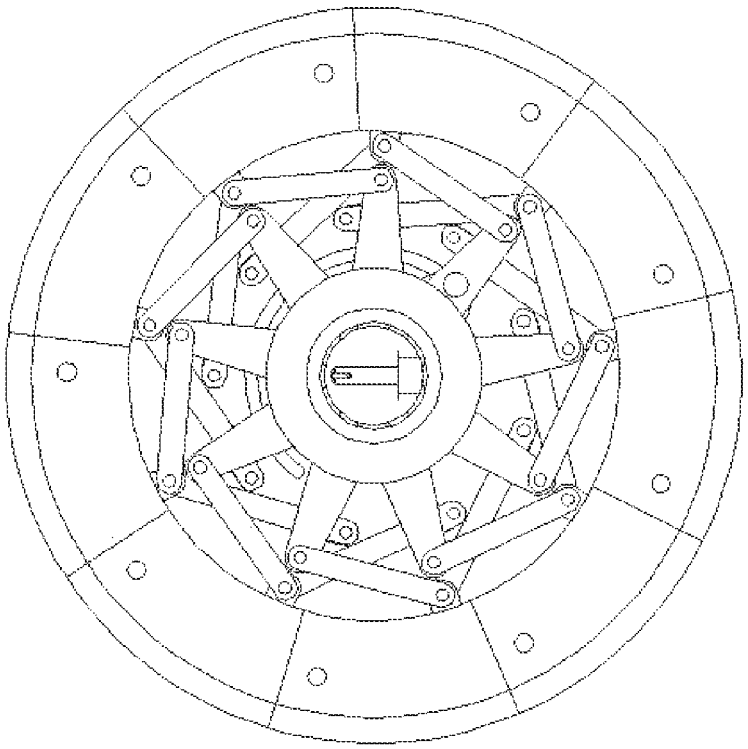
FIG. 6 is a schematic diagram of a mandrel segment of the present disclosure, where the mandrel segment presents the smallest diameter.
Figure 7:
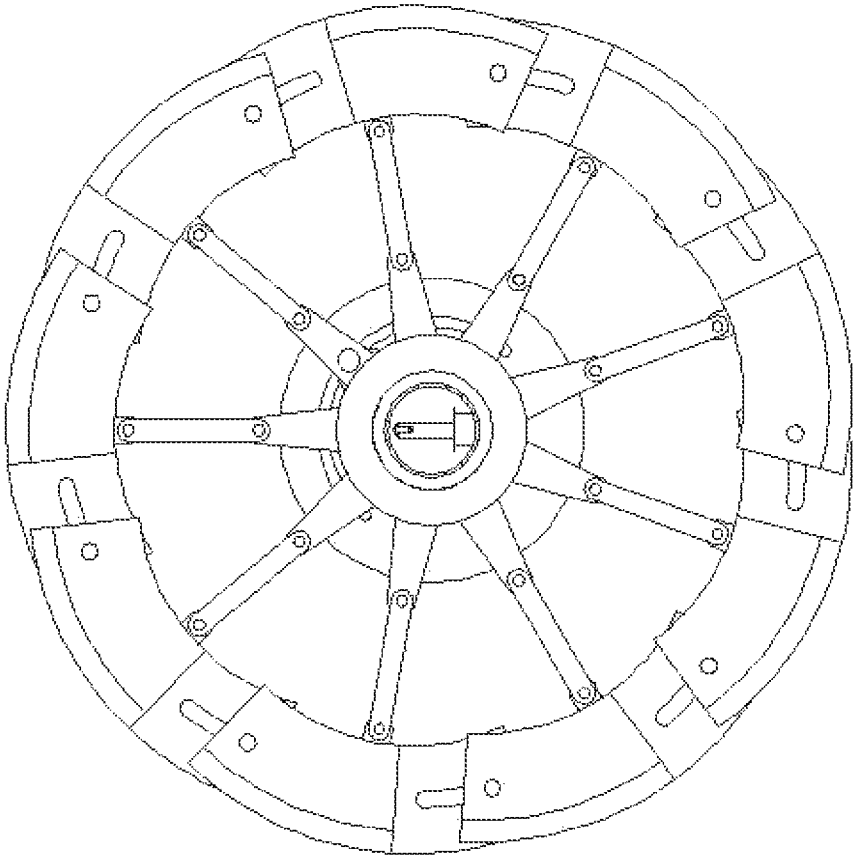
FIG. 7 is a schematic diagram of a mandrel segment of the present disclosure, where the mandrel segment presents the largest diameter.

Example and an implementation process thereof:

In an initial position, the pawl sliding shaft 13 slides to a position of the arc sliding groove 20 in FIG. 4, and a diameter of the movable mandrel segment 4 is shown in FIG. 6, which is the smallest diameter; when the straight shank 1 is fixed (that is, the connecting rod mounting flange 12, the ratchet wheel 14, and the reverse ratchet wheel 15 of each movable mandrel segment all are fixed), a rotation of the pawl mounting frame 8 along the arc sliding groove 20 can make a diameter of the movable mandrel segment gradually increase to a value required by the bending processing of a circular pipe fitting; and the pawl mounting frame 8 can continue to rotate to a position shown in FIG. 7, which corresponds to the largest diameter of the movable mandrel segment 4. In the above process, the reverse pawl 19 on the pawl sliding shaft 13 always meshes with the reverse ratchet wheel 15, which prevents a reverse rotation of the pawl mounting frame 8, thereby ensuring that a diameter of the mandrel will not be reduced in use and reliable internal support can be provided inside a pipe blank, after the pawl mounting frame 8 rotates to the position resulting in the largest diameter of the movable mandrel segment shown in FIG. 7, the pawl mounting frame 8 continues to rotate, such that sizes of the long and short connecting rods are gradually reduced to ensure the diameter of the movable mandrel segment 4, thereby facilitating storage; the mandrel can also be adjusted to a size required for the next processing, and thus during the next processing, it only needs to push the pawl sliding shaft 13 in the axial direction until the pawl 18 meshes with the ratchet wheel 14 to prevent a diameter of the movable mandrel segment 4 from being reduced; and when the pawl 18 and the ratchet wheel 14 are in engagement, the reverse pawl 19 and the reverse ratchet wheel 15 are disengaged from each other.

What is claimed is:

1. A variable-diameter full-support mandrel structure with a cross section for preventing a reverse rotation of a ratchet wheel, comprising a straight shank and three movable mandrel segments, wherein the straight shank and the three movable mandrel segments are connected through quick-disconnect universal joints;

an inside of each of the movable mandrel segments has a shafting structure, the shafting structure comprises a rotating shaft, a bearing, a ratchet mechanism, a connecting rod mounting flange, and slider components;

the ratchet mechanism comprises a pawl mounting frame, a pawl sliding shaft, the ratchet wheel, a reverse ratchet wheel, a pawl, and a reverse pawl;

the rotating shaft comprises a front shaft segment, a middle shaft segment, and a rear shaft segment, wherein the front shaft segment, the middle shaft segment, and the rear shaft segment are connected in sequence;

the middle shaft segment has a regular hexagonal cross section, and the front shaft segment and the rear shaft segment have a circular cross section;

a shaft shoulder is provided at a transition between the front shaft segment and the middle shaft segment, and the shaft shoulder serves as a first end of the rotating shaft for axial location;

the connecting rod mounting flange, the ratchet wheel, and the reverse ratchet wheel are fitted with and sequentially sleeved on the middle shaft segment, wherein each of the connecting rod mounting flange, the ratchet wheel, and the reverse ratchet wheel is provided with a regular hexagonal central hole;

an outer diameter of the rear shaft segment is smaller than an outer diameter of the middle shaft segment, the bearing and a limit clamp ring are sequentially sleeved on the rear shaft segment, and the limit clamp ring serves as a second end of the rotating shaft for the axial location;

an inner ring of the bearing is in tight contact with an end face of the reverse ratchet wheel, and the pawl mounting frame is mounted on an outer ring of the hearing;

a plurality of protrusions are evenly arranged on an outer side face of the pawl mounting frame in a circumferential direction, a mounting hole is formed at each protrusion of the plurality of protrusions and is adjacent to an outer end of the each protrusion, and a quadrilateral hole is formed at one protrusion of the plurality of protrusions and is adjacent to an end of the rotating shaft:

a plurality of through holes are evenly arranged along an outer edge of the connecting rod mounting flange in the circumferential direction;

an arc sliding groove arranged coaxially with the outer edge of the connecting rod mounting flange is formed on the connecting rod mounting flange, and the arc sliding groove is located between the plurality of through holes and a maximum diameter of the ratchet wheel;

a first end of the pawl sliding shaft passes through the arc sliding groove, and a second end of the pawl sliding shaft passes through the quadrilateral hole of the one protrusion of the pawl mounting frame;

the pawl sliding shaft moves back and forth along a central axis of the quadrilateral hole, and both ends of the pawl sliding shaft are provided with flanges to prevent the pawl sliding shaft from disengaging from the arc sliding groove or the quadrilateral hole during a sliding process;

a pawl assembly is fixedly sleeved on the pawl sliding shaft located between the connecting rod mounting flange and the pawl mounting frame, and the pawl assembly is for connecting the pawl and the reverse pawl;

each of the plurality of protrusions on the pawl mounting frame and each of the plurality of through holes in the connecting rod mounting flange corresponding to each of the plurality of protrusions are connected to an identical slider component through a short connecting rod and a long connecting rod;

each of the slider components has a Z-shaped structure composed of two layers of arc blocks;

a first end of the short connecting rod and a first end of the long connecting rod are respectively hinged to inner walls of the two layers of arc blocks to form coaxial revolute pairs, and a second end of the short connecting rod and a second end of the long connecting rod are respectively hinged to the mounting, hole of the each protrusion on the pawl mounting frame and the through hole of the connecting rod mounting flange;

a positioning pin hole is formed on a first layer of the two layers of arc blocks along a central axis of the rotating shaft, and a slider positioning pin is mounted inside the positioning pin hole through interference fit;

a second layer of the two layers of arc blocks is provided with a slider positioning pin sliding groove fitted with the slider positioning pin in an adjacent slider component;

a positioning pin on a slider component is inserted into the slider positioning pin sliding groove on an adjacent slider component;

the slider components are connected in the circumferential direction to form a complete circular ring;

the quick-disconnect universal joint comprises a fixed joint and a quick-disconnect joint, wherein the fixed joint and the quick-disconnect joint are hinged through a universal joint;

a central blind hole for mounting the rotating shaft of each of the movable mandrel segments or a connecting shaft of the straight shank is formed on each of the fixed joint and the quick-disconnect joint at both ends of the quick-disconnect universal joint;

the quick-disconnect joint is connected to a central hole of the universal joint through a quick-disconnect shaft;

a first end of the quick-disconnect shaft is in an interference fit with the quick-disconnect joint, and a second end of the quick-disconnect shaft is hinged to a limit shaft; and when the limit shaft is adjusted to be not coaxial with the quick-disconnect shaft, the quick-disconnect joint is limited and does not disengage.

2. The variable-diameter full-support mandrel structure according to claim 1, wherein the rotating shaft is relatively fixed, the pawl sliding shaft slides along the arc sliding groove to drive the pawl mounting frame to rotate relative to the rotating shaft, wherein the slider components are driven to move in a radial direction under a guidance of a mechanism movement of the short connecting rod and the long connecting rod to change a diameter of one of the movable mandrel segments; and after the diameter of the one of the movable mandrel segments increases, gaps between adjacent slider components on the circumferential direction are filled by the two layers of arc blocks.

3. The variable-diameter full-support mandrel structure according to claim 2, wherein when the pawl sliding shaft slides from a first end of the arc sliding groove to a second end of the arc sliding groove, an outer diameter of the one of the movable mandrel segments first increases to a limit value and then decreases.

4. The variable-diameter full-support mandrel structure according to claim 1, wherein ratchet teeth of the ratchet wheel and ratchet teeth of the reverse ratchet wheel are arranged in opposite directions.

5. The variable-diameter full-support mandrel structure according to claim 4, wherein when the pawl assembly of the pawl sliding shaft is pushed to he in contact with the pawl mounting frame, the reverse pawl cooperates with the reverse ratchet wheel to prevent the reverse rotation, and the pawl and the ratchet wheel are in a first disengaged state; and when the pawl sliding shaft is pushed to be in contact with the pawl assembly and the connecting rod mounting flange, the pawl cooperates with the ratchet wheel, and the reverse pawl and the reverse ratchet wheel are in a second disengaged state.

6. The variable-diameter full-support mandrel structure according to claim 1, wherein a shaft segment of the pawl sliding shaft has a quadrilateral cross section matched with the quadrilateral hole of the one protrusion to limit a rotation of the pawl sliding shaft relative to the pawl mounting frame, wherein the shaft segment of the pawl sliding shaft is slidably connected to the one protrusion on the pawl mounting frame; and a shaft segment of the middle shaft segment is configured to limit a rotation of the connecting rod mounting flange, the ratchet wheel, and the reverse ratchet wheel relative to the rotating shaft, wherein the shaft segment of the middle shaft segment has a regular hexagonal cross section.

7. The variable-diameter full-support mandrel structure according to claim 1, wherein an outer ring of each of the movable mandrel segments comprises an odd number of slider components.

* * * * *